US010096927B2

(12) United States Patent
Hashiguchi

(10) Patent No.: US 10,096,927 B2
(45) Date of Patent: Oct. 9, 2018

(54) HOLDING MEMBER

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/866,886

(22) Filed: Jan. 10, 2018

(65) Prior Publication Data

US 2018/0248292 A1 Aug. 30, 2018

(30) Foreign Application Priority Data

Feb. 28, 2017 (JP) ..... 2017-036386

(51) Int. Cl.

| | |
|---|---|
| ***H01R 13/625*** | (2006.01) |
| ***H01R 13/422*** | (2006.01) |
| ***H01R 13/436*** | (2006.01) |
| ***H01R 13/56*** | (2006.01) |

(52) U.S. Cl.

CPC ..... *H01R 13/422* (2013.01); *H01R 13/436* (2013.01); *H01R 13/562* (2013.01)

(58) Field of Classification Search

CPC ... H01R 13/562; H01R 13/422; H01R 13/436

USPC ..... 439/345, 578

See application file for complete search history.

(56) References Cited

U.S. PATENT DOCUMENTS

| | | | | |
|---|---|---|---|---|
| 4,863,396 A * | 9/1989 | Johnson | ..... | H01R 13/508 439/446 |
| 5,076,656 A * | 12/1991 | Briggs | ..... | G02B 6/3807 385/60 |
| 6,220,888 B1 * | 4/2001 | Correa | ..... | H01R 13/562 439/445 |
| 7,201,603 B1 * | 4/2007 | Finona | ..... | H01R 13/562 174/86 |

(Continued)

FOREIGN PATENT DOCUMENTS

| | | |
|---|---|---|
| DE | 10 2004 041809 A1 | 4/2005 |
| EP | 2 273 619 A1 | 1/2011 |

(Continued)

OTHER PUBLICATIONS

Extended European Search Report in EP 18152600.5, dated Jul. 2, 2018.

*Primary Examiner* — Abdullah Riyami
*Assistant Examiner* — Vladimir Imas
(74) *Attorney, Agent, or Firm* — Collard & Roe, P.C.

(57) ABSTRACT

A first holding member has first stop portions, and a second holding member has one or more support portions and one or more second stop portions. Each of the second stop portions is supported by one of the support portions to be movable in a direction intersecting with a front-rear direction in accordance with resilient deformation of the one of the support portions. When the first holding member and the second holding member are combined with each other, the first stop portions are grouped into a first group and a second group, each of the second stop portions faces one or more of the first stop portions of the first group in the front-rear direction, and each of the first stop portions of the second group faces none of the second stop portions in the front-rear direction.

13 Claims, 9 Drawing Sheets

(56) References Cited

U.S. PATENT DOCUMENTS

| | | | | |
|---|---|---|---|---|
| 7,335,065 | B1 * | 2/2008 | Chen | H01R 13/6272 439/654 |
| 7,507,125 | B2 * | 3/2009 | Okamura | H01R 13/506 439/680 |
| 7,794,274 | B2 * | 9/2010 | Phillips, Jr. | H01R 13/187 439/578 |
| 7,922,511 | B1 * | 4/2011 | Schweitzer | H01R 13/625 439/171 |
| 7,980,894 | B1 * | 7/2011 | Hall | H01R 24/40 439/585 |
| 8,182,285 | B2 * | 5/2012 | Annequin | H01R 24/54 439/582 |
| 8,628,359 | B2 * | 1/2014 | Yokoyama | H01R 43/16 439/675 |
| 8,708,732 | B2 * | 4/2014 | Toda | H01R 13/622 439/352 |
| 8,757,915 | B2 * | 6/2014 | Sugimoto | G02B 6/3897 385/60 |
| 9,537,231 | B2 * | 1/2017 | Hall | H01R 9/0518 |
| 9,746,618 | B2 * | 8/2017 | Ishiguro | G02B 6/3829 |
| 9,787,017 | B1 * | 10/2017 | Lane | H01R 9/05 |
| 9,960,527 | B2 * | 5/2018 | Dowhower | H01R 13/5812 |
| 9,960,550 | B2 * | 5/2018 | Ensley | H01R 13/424 |
| 2007/0093120 | A1 | 4/2007 | Hardy et al. | |
| 2012/0202372 | A1 * | 8/2012 | Hardy | H01R 9/0518 439/460 |

FOREIGN PATENT DOCUMENTS

| | | | |
|---|---|---|---|
| JP | 2015-088256 | A | 5/2015 |
| WO | 2014/160785 | A1 | 10/2014 |

* cited by examiner

HOLDING MEMBER

CROSS REFERENCE TO RELATED APPLICATIONS

This application is based on and claims priority under 35 U.S.C. § 119 to Japanese Patent Application No. JP2017-036386 filed Feb. 28, 2017, the content of which is incorporated herein in its entirety by reference.

BACKGROUND OF THE INVENTION

This invention relates to a holding member which is configured to form a cable connector.

When a connector is connected to a cable, the cable is sometimes required to extend from the connector in a direction different from a mating direction along which the connector is mated with a mating connector. For example, a connector which has a structure satisfying such a requirement is disclosed in JP 2015-88256A (Patent Document 1), the content of which is incorporated herein by reference.

Referring to FIG. 14, Patent Document 1 discloses a connector unit (first connector unit) 90 which comprises contacts 910, a connector housing (housing) 920 and a cable-protection-and-regulation cover (cover) 940. The housing 920 holds the contacts 910. The contacts 910 are connected to cables 930, respectively. The cover 940 defines an extending direction along which each of the cables 930 starts to extend from the connector 90. The housing 920 has a rectangular column shape which has a longitudinal direction in a front-rear direction. The housing 920 has four corners located at an end thereof in the longitudinal direction. Each of the four corners is provided with a connector-side lock projection (lock projection) 922 which projects outward from an outer surface of the housing 920 (FIG. 14 shows three of the lock projections 922). The lock projections 922 are located in four-fold rotational symmetry with respect to an axis AX extending along the front-rear direction. The cover 940 has a rectangular tube shape with bottom. The cover 940 has opposite sidewalls each of which is formed with a cable passage opening (opening) 942. In addition, the cover 940 has four inside corners each of which is provided with a cover-side lock projection (lock projection) 944 (FIG. 14 shows one of the lock projections 944). The lock projections 944 are located in four-fold rotational symmetry with respect to the axis AX and correspond to the lock projections 922, respectively. When the cover 940 is attached to the housing 920, the lock projections 944 are moved forward, surmount the lock projections 922 from behind, respectively, and are engaged with the lock projections 922, respectively. The cover 940 is attachable to the housing 920 even under a state where the cover 940 is rotated by ninety degrees about the axis AX. This rotation of the cover 940 changes a facing direction of each of the openings 942, so that the extending direction of each of the cables 930 can be changed.

Referring to FIG. 15, Patent Document 1 discloses another connector unit (second connector unit) 95 which comprises a connector housing (housing) 950 and a cable-protection-and-regulation cover (cover) 960. The housing 950 has a cylindrically shaped cable extending end (end) 952, and the cover 960 has a cylindrically shaped open end (end) 962. In addition, the cover 960 is provided with a pair of cable passage openings (openings) 964. The end 952 of the housing 950 has an outer surface which is formed with connector-side lock depressions (lock depressions) 954 which are located at regular intervals in a circumference direction of an axis AX. The end 962 of the cover 960 has an inner surface which is formed with cover-side lock projections (lock projections) 964 which are located at regular intervals in the circumference direction of the axis AX. The lock projections 964 are provided at positions corresponding to those of the lock depressions 954, respectively. When the cover 960 is attached to the housing 950, the lock projections 964 are fit into the lock depressions 954, respectively. In the attachment process of the cover 960 to the housing 950, the cover 960 can be attached to the housing 950 even under a state where the cover 960 is rotated by a predetermined angle about the axis AX. This rotation of the cover 960 changes a facing direction of each of the openings 964 relative to the housing 950, so that an extending direction of a cable (not shown) can be changed.

According to the first connector unit 90 disclosed in Patent Document 1, the extending direction of each of the cables 930 can be changed only by integer times of ninety degrees. In contrast, according to the second connector unit 95 disclosed in Patent Document 1, the extending direction of the cable can be changed by the predetermined angle which is smaller than ninety degrees. However, the second connector unit 95 is degraded in comparison with the first connector unit 90 in ability of maintaining an attached state where the cover 960 is attached to the housing 950.

SUMMARY OF THE INVENTION

It is therefore an object of the present invention to provide a holding member which facilitates to change an extending direction of a cable by small degrees and can securely maintain a combined state where a contact-holding member for holding a contact and a cable-holding member for holding a cable are combined with each other.

An aspect of the present invention provides a holding member configured to form a connector which comprises a contact connected to a cable. The holding member comprises a first holding member and a second holding member, one of which is configured to hold the contact, and a remaining one of which is configured to hold the cable. The first holding member and the second holding member have a first imaginary axis and a second imaginary axis, respectively. The first holding member and the second holding member are combinable with each other along a front-rear direction under a state where the first imaginary axis and the second imaginary axis are equal to each other. One of the first holding member and the second holding member that is configured to hold the cable has a cable-holding portion which is configured to hold a part of the cable so that the cable extends in a direction different from the front-rear direction. The first holding member has first stop portions. The second holding member has one or more support portions and one or more second stop portions. Each of the support portions is resiliently deformable. Each of the second stop portions is supported by one of the support portions. Each of the second stop portions supported by the one of the support portions is movable in a direction intersecting with the front-rear direction in accordance with resilient deformation of the one of the support portions. Under a combined state where the first holding member and the second holding member are combined with each other, the first stop portions are grouped into a first group of one or more of the first stop portions and a second group of remaining one or more of the first stop portions, each of the second stop portions faces one or more of the first stop portions of the first group in the front-rear direction, and each of the first stop portions of the second group faces none of the second stop portions in the front-rear direction.

According to an aspect of the present invention, in a combination process of the first holding member and the second holding member, each of the second stop portions is arranged to correspond to one or more of the first stop portions of the first group, or one or more of the first stop portions selected from the first stop portions. According to this correspondence, a relative angle of the second holding member relative to the first holding member can be changed by small degrees. Moreover, the first stop portions include the first stop portions of the second group each of which corresponds to none of the second stop portions under the combined state where the first holding member and the second holding member are combined with each other. In other words, the first stop portions are intentionally designed so as to include one or more of the first stop portions which are not used for the second stop portions. This design facilitates to suppress increase of the number of the support portions which support the second stop portions. As a result, complication of a structure of the second holding member can be avoided, and strength of the second holding member can be secured. As described above, according to an aspect of the present invention, the relative angle of the second holding member relative to the first holding member can be adjusted by small degrees while the structure of the second holding member is simplified and strengthened.

An appreciation of the objectives of the present invention and a more complete understanding of its structure may be had by studying the following description of the preferred embodiment and by referring to the accompanying drawings.

Figure 1:
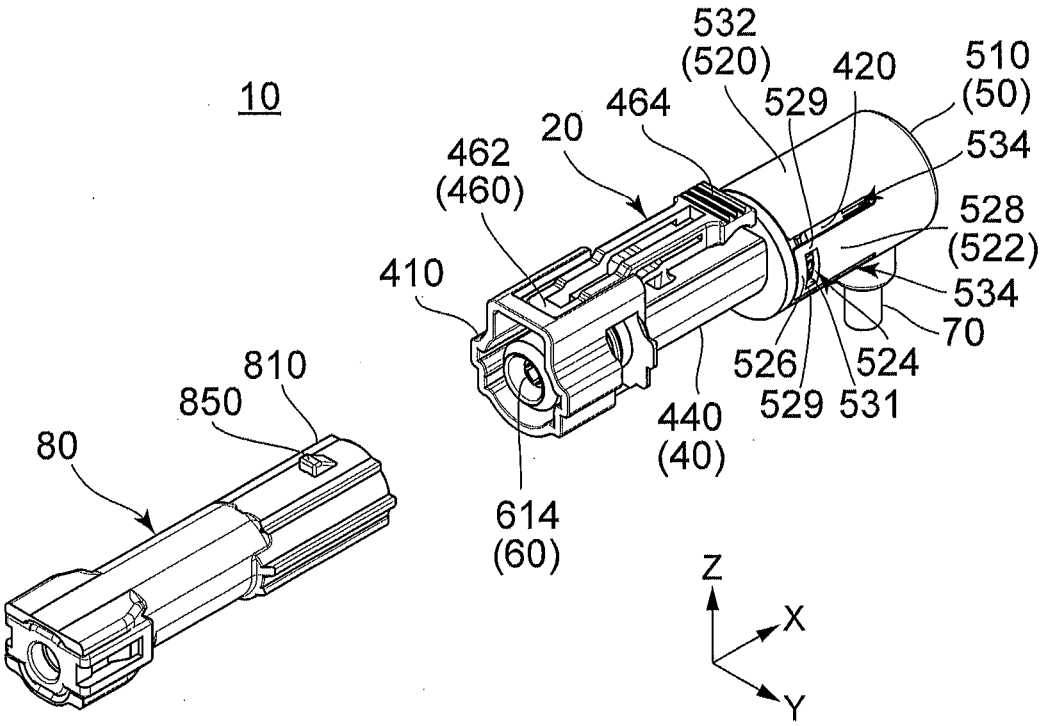
FIG. 1 is a perspective view showing a connector assembly according to a first embodiment of the present invention, wherein the connector assembly includes a connector and a mating connector which are not mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
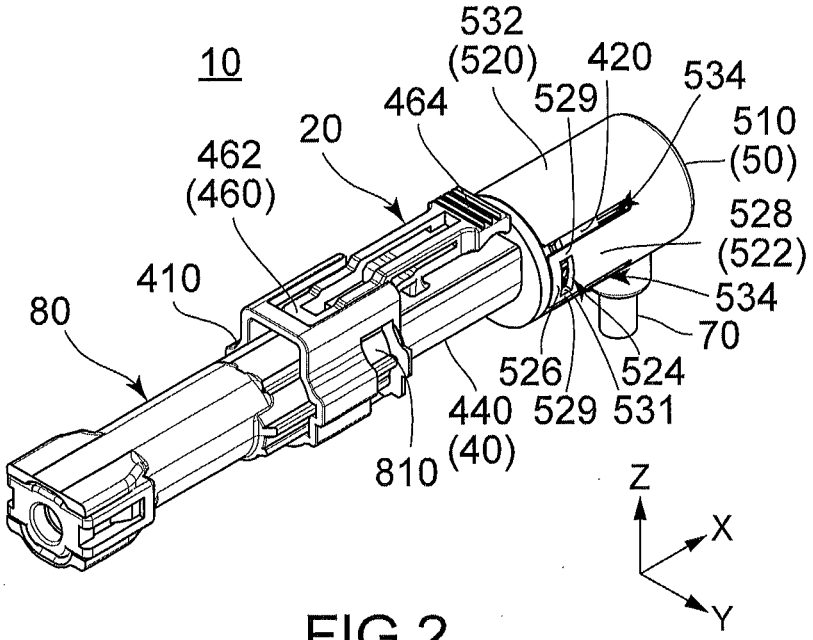
FIG. 2 is another perspective view showing the connector assembly of FIG. 1, wherein the connector and the mating connector are mated with each other.

Referring to FIGS. 1 and 2, a connector assembly 10 according to a first embodiment of the present invention comprises a connector 20 and a mating connector 80. As can be seen from FIGS. 1 and 2, the connector 20 and the mating connector 80 are mateable with each other and removable from each other along a mating direction. In the present embodiment, the mating direction is a front-rear direction, or the X-direction. Moreover, "forward" means the negative X-direction, and "rearward" means the positive X-direction.

Figure 3:
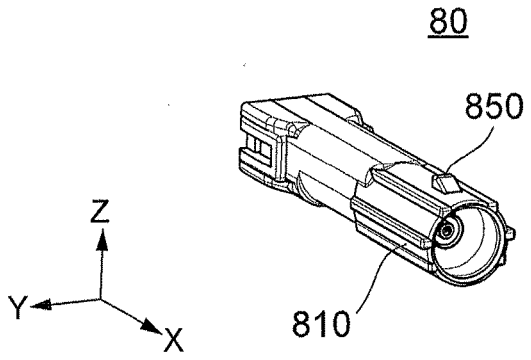
FIG. 3 is a perspective view showing the mating connector of the connector assembly of FIG. 1.

As shown in FIGS. 1 and 2, the connector 20 has a fit portion 410 and a lock mechanism 460. As shown in FIGS. 1 and 3, the mating connector 80 has a mating fit portion 810. The mating fit portion 810 is provided with a locked portion 850. As can be seen from FIGS. 1 and 2, under a mated state where the connector 20 and the mating connector 80 are mated with each other, the mating fit portion 810 is partially received in the fit portion 410. Under this mated state, the locked portion 850 is located inside the fit portion 410. In addition, a lock portion 462 of the lock mechanism 460 is located forward of the locked portion 850. The lock portion 462 is engaged with the locked portion 850 and locks the mated state of the connector 20 with the mating connector 80. When an operation portion 464 of the lock mechanism 460 is operated, the lock by the lock portion 462 is unlocked, and the connector 20 and the mating connector 80 can be removed from each other.

Figure 8:
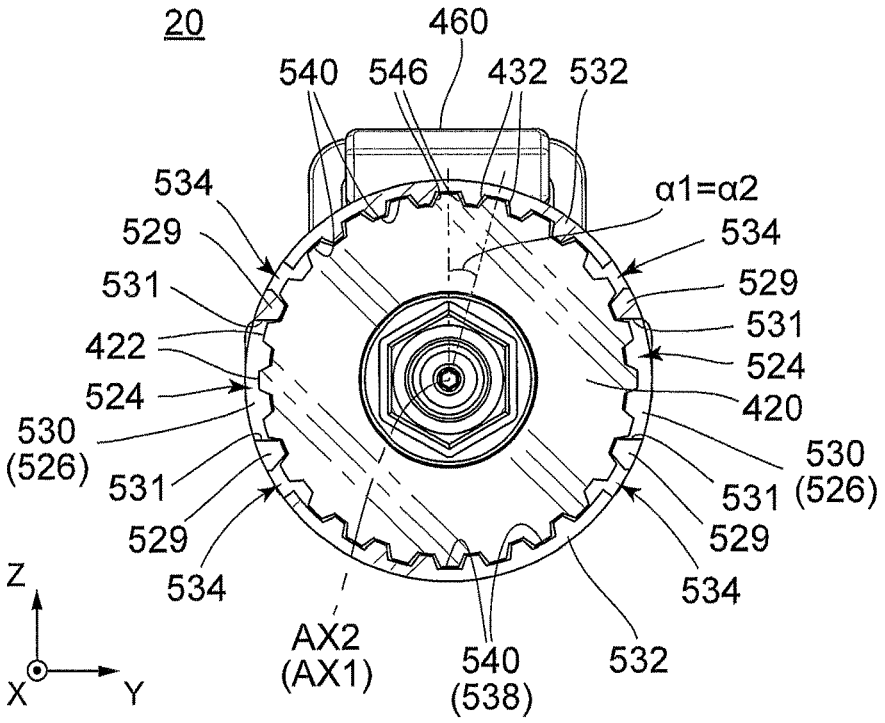
FIG. 8 is a cross-sectional view showing the connector of FIG. 5, taken along line A-A.

As can be seen from FIGS. 1, 3 and 8, in the present embodiment, each of the connector 20 and the mating connector 80 is a coaxial connector. In general, paired coaxial connectors are mateable with each other even under a state where one of the paired coaxial connectors is rotated relative to a remaining one of the paired coaxial connectors about a mating axis, or an axis along the mating direction. In other words, a general coaxial connector has a fit portion which has a rotationally symmetric shape about the mating axis. In contrast, as described above, the connector 20 and the mating connector 80 of the present embodiment have the lock mechanism 460 and the locked portion 850, respectively. Each of the thus-formed fit portion 410 and the thus-formed mating fit portion 810 of the present embodiment has a shape which is not rotationally symmetric about the mating axis. According to this structure, the connector 20 can be mated with the mating connector 80 only when the connector 20 takes a predetermined posture relative to the mating connector 80. Under the mated state of the connector 20 with the mating connector 80, the aforementioned structure regulates a rotation of the connector 20 relative to the mating connector 80 about an axis extending along the mating direction. The present invention is not limited to a coaxial connector comprising a lock mechanism, etc. but applicable to various types of connectors each of which is configured so that a rotation thereof about an axis extending along a mating direction is regulated under a mated state with a mating connector. Moreover, the connector, to which the present invention is applied, is mateable with an existing mating connector. In other words, the structure of the mating connector is not required to be changed even in a case where the present invention is applied to the connector.

Referring to FIGS. 4 to 7, the connector 20 comprises a holding member 30. The holding member 30 holds a contact 60 and a cable 70. In the present embodiment, the contact 60 is formed of a center conductor 612 and an outer conductor 614. The cable 70 is connected to the center conductor 612 and the outer conductor 614. Thus, the holding member 30 is configured to form the connector 20 which comprises the contact 60 connected to the cable 70.

Figure 10:
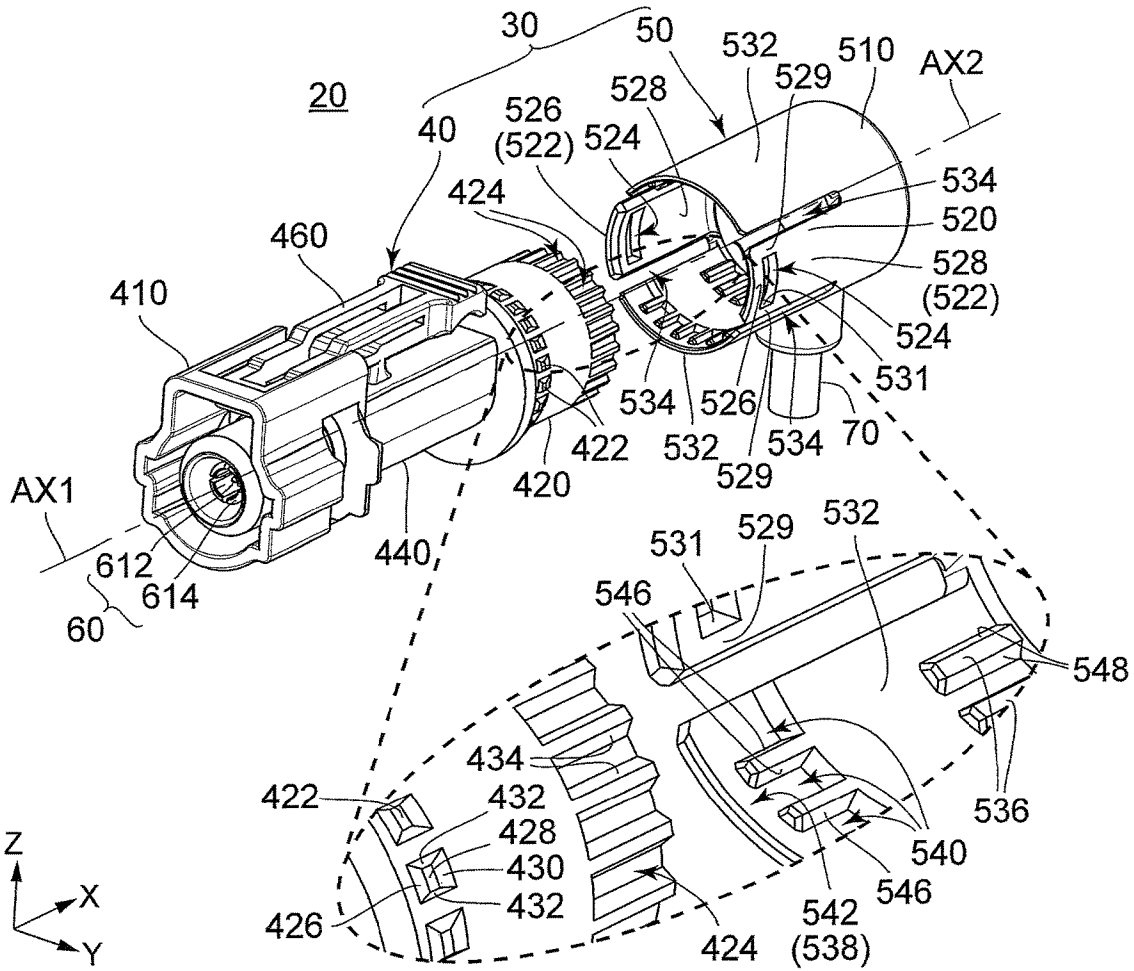
FIG. 10 is a perspective view showing the connector of FIG. 4, wherein the connector includes a holding member formed of a contact-holding member and the cable-holding member which are not combined with each other, an unillustrated cable extends between the contact-holding member and the cable-holding member, and an attached portion of the contact-holding member and a receiving portion of the cable-holding member are partially enlarged to be illustrated.

Referring to FIG. 10, the holding member 30 comprises a contact-holding member (first holding member) 40 and a cable-holding member (second holding member) 50. The contact-holding member 40 is configured to hold the contact 60, and the cable-holding member 50 is configured to hold the cable 70. The contact-holding member 40 and the cable-holding member 50 are combined with each other along the front-rear direction to form the holding member 30. The contact-holding member 40 and the cable-holding member 50 have a first imaginary axis AX1 extending along the front-rear direction and a second imaginary axis AX2 extending along the front-rear direction, respectively. The contact-holding member 40 and the cable-holding member 50 are combined with each other along the front-rear direction under a state where the first imaginary axis AX1 and the second imaginary axis AX2, which are defined as described above, are equal to each other.

As shown in FIG. 10, the contact-holding member 40 has the fit portion 410, an attached portion 420 and a coupling portion 440 which couples the fit portion 410 and the attached portion 420 to each other. The coupling portion 440 is provided with the lock mechanism 460. The fit portion 410, the coupling portion 440 and the attached portion 420 are arranged along the first imaginary axis AX1. As can be seen from FIGS. 8 to 10, the attached portion 420 has a rotationally symmetric shape about the first imaginary axis AX1. In the present embodiment, the attached portion 420 has a cylindrical shape. However, the present invention is not limited thereto, but the attached portion 420 may have a regular polygonal shape. As can be seen from FIG. 10, in the present embodiment, a central axis (mating axis) of the center conductor 612 is equal to the first imaginary axis AX1. However, the present invention is not limited thereto, but the central axis of the center conductor 612 may be shifted from or may be intersect with the first imaginary axis AX1.

Figure 9:
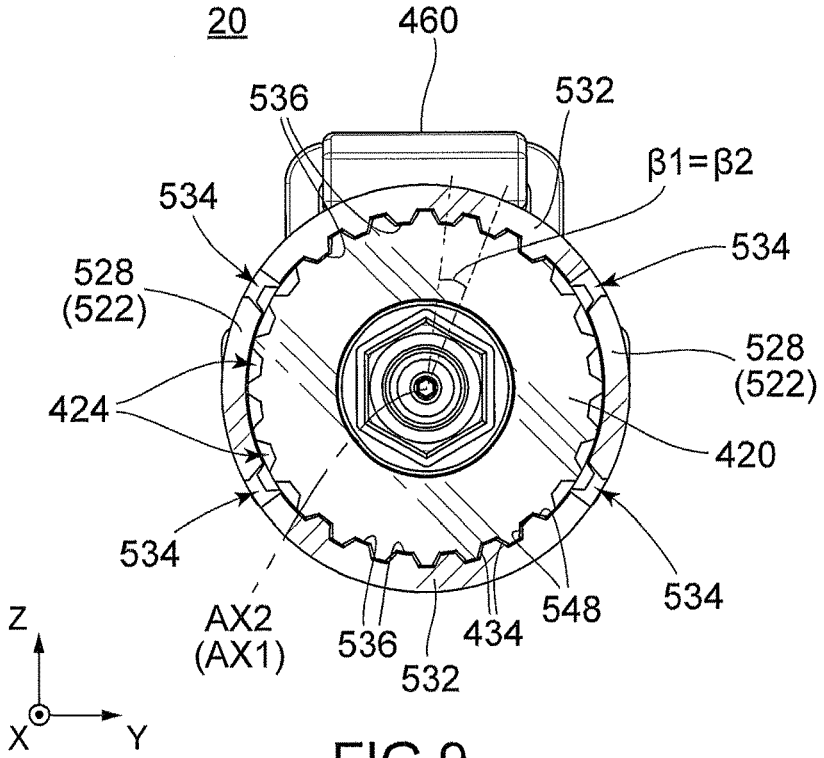
FIG. 9 is a cross-sectional view showing the connector of FIG. 5, taken along line B-B.

As shown in FIG. 10, the attached portion 420 has an outer circumference surface which is provided with two or more projections 422 and two or more channels 424. The projections 422 are located at a front part of the attached portion 420, and the channels 424 are located at a rear end of the attached portion 420. Each of the projections 422 has a front surface 426, an upper surface 428, a rear surface 430 and a pair of side surfaces 432. As described later, the front surface 426 of each of the projections 422 works as a first stop portion 426. Thus, the contact-holding member 40 has the first stop portions 426. Moreover, each of the channels 424 has opposite sidewalls 434. As described later, each of the sidewalls 434 of each of the channels 424 works as a first rotation preventer 434. Thus, the contact-holding member 40 is formed with the first rotation preventers 434. As shown in FIG. 8, the projections 422 are formed on the outer circumference surface of the attached portion 420 at first regular intervals. Therefore, the first stop portions 426, or the front surfaces 426 of the projections 422, are arranged at regular intervals in a circumference direction of the first imaginary axis AX1 (see FIG. 10). Moreover, as shown in FIG. 9, the channels 424 are formed on the outer circumference surface of the attached portion 420 at second regular intervals. As can be seen from FIGS. 8 and 9, the number of the projections 422 and the number of the channels 424 are equal to each other. When the attached portion 420 is seen along the front-rear direction, an angle $\alpha 1$ is defined by two lines which link the adjacent two projections 422 to the first imaginary axis AX1, an angle $\beta 1$ is defined by two lines which link the adjacent two channels 424 to the first imaginary axis AX1, and each of the angle $\alpha 1$ and the angle $\beta 1$ is equal to an adjustable angle. The adjustable angle is the minimum value of difference between two relative angles which correspond to two different states, respectively, in each of which the contact-holding member 40 and the cable-holding member 50 can be combined with each other, wherein each of the relative angles is the angle of the cable-holding member 50 relative to the contact-holding member 40 about both the first imaginary axis AX1 and the second imaginary axis AX2. In the present embodiment, the number of the projections 422 is twenty four, and the number of the channels 424 is twenty four, so that the adjustable angle is fifteen degrees. However, the present invention is not limited thereto. Each of the number of the projections 422 and the number the channels 424 may be more than or less than twenty four.

Referring to FIG. 10, the cable-holding member 50 has a base portion 510 and a receiving portion 520 located forward of the base portion 510. The base portion 510 is configured to hold a part of the cable 70 so that the cable 70 extends in a direction different from the front-rear direction. Thus, the base portion 510 works as a cable holding portion 510. The receiving portion 520 has one or more holding portions 522. In the present embodiment, the number of the holding portions 522 is two. However, the number of the holding portions 522 does not need to be two. Each of the holding portions 522 is formed with one or more recessed portions 524. In other words, the cable-holding member 50 has one or more of the recessed portions 524. In the present embodiment, each of the recessed portions 524 is a hole which passes through one of the holding portions 522 in a radial direction of the second imaginary axis AX2. Each of the recessed portions 524 may be a recess provided to the holding portion 522 so as to open inward of the receiving portion 520. However, the hole can be easily made in comparison with the recess. Moreover, under a combined state where the contact-holding member 40 and the cable-holding member 50 are combined with each other, the hole is easily visible in comparison with the recess. Each of the holding portions 522 has a front end portion 526 located forward of the recessed portion 524 and a support portion 528 which supports the front end portion 526. Each of the recessed portions 524 passes through one of the support portions 528. Each of the support portions 528 has a pair of support beams 529. Each of the support beams 529 is located outward of the recessed portion 524 in a circumference direction of the second imaginary axis AX2. Each of the support beams 529 supports the front end portion 526 and partially defines the recessed portion 524. Each of the recessed portions 524 has opposite side surfaces 531 each of which is an inside surface of the support beam 529 in the circumference direction of the second imaginary axis AX2. Each of the front end portions 526 has a rear surface, or a front inner surface 530 (see FIGS. 5 and 8), which partially defines the recessed portion 524. As can be seen from FIG. 5, each of the front inner surfaces 530 faces rearward in the front-rear direction. Each of the support portions 528 is resiliently deformable so that the front end portion 526 is movable in an intersecting direction intersecting with the front-rear direction. Thus, each of the front inner surfaces 530 is movable in the intersecting direction intersecting with the front-rear direction. As described later, each of the front inner surfaces 530 works as a second stop portion 530. As described above, the cable-holding member 50 has one or more of the support portions 528 and one or more of the second stop portions 530. Each of the support portions 528 is resiliently deformable. Each of the second stop portions 530 is supported by one of the support portions 528 to be movable in the intersecting direction intersecting with the front-rear direction in accordance with resilient deformation of the one of the support portions 528.

As shown in FIG. 10, the receiving portion 520 of the cable-holding member 50 has one or more cover portions 532 which extend forward from the base portion 510. In the present embodiment, the number of the cover portions 532 is two. The cover portions 532 and the holding portions 522 are alternately arranged in the circumference direction of the second imaginary axis AX2. The receiving portion 520 is provided with slits 534 each of which is located between the cover portion 532 and the holding portion 522 that are adjacent to each other in the circumference direction of the second imaginary axis AX2. Each of the slits 534 extends along the front-rear direction. Each of the thus-arranged slits 534 is located between one of the cover portions 532 and one of the holding portions 522 in the circumference direction of the second imaginary axis AX2. Therefore, each of the support beams 529 of the holding portion 522 is located between one of the slits 534 and one of the recessed portions 524 in the circumference direction of the second imaginary axis AX2. As can be seen from FIGS. 9 and 10, when the receiving portion 520 is seen along the front-rear direction, each of the holding portions 522 and the cover portions 532 has an arc shape of a predetermined curvature. In addition, in the circumference direction of the second imaginary axis AX2, a size of each of the cover portions 532 is larger than another size of each of the support portions 528. According to the aforementioned structure, each of the cover portions 532 is hard to be resiliently deformed in comparison with each of the support portions 528. In the present embodiment, the holding portions 522 and the cover portions 532 are arranged in rotationally symmetry about the second imaginary axis AX2, and each of the holding portions 522 and the cover portions 532 forms a part of a cylinder. However, the present invention is not limited thereto. For example, the receiving portion 520 does not need to have a rotationally symmetric shape about the second imaginary axis AX2, provided that the attached portion 420 is receivable in the receiving portion 520. Moreover, the receiving portion 520 may be provided with none of the cover portions 532. However, when one or more of the cover portions 532 are provided, the cable-holding member 50 can be easily used and may be improved in strength. When one or more of the cover portions 532 are provided, the cable-holding member 50 has two or more of the slits 534.

Referring to FIGS. 8 to 10, each of the cover portions 532 is formed with two or more projecting portions 536 and a channel 538. Each of the channels 538 includes two or more receiving channels 540 and a coupling channel 542 which couples the receiving channels 540 to one another. Each of the projecting portions 536 extends in the front-rear direction, and each of the receiving channels 540 extends in the front-rear direction. When the receiving portion 520 is seen along the front-rear direction, an angle $\beta 2$ is defined by two lines which link the adjacent two projecting portions 536 to the second imaginary axis AX2, and the angle $\beta 2$ is equal to the adjustable angle. Similarly, when the receiving portion 520 is seen along the front-rear direction, an angle $\alpha 2$ is defined by two lines which link the adjacent two channels 538 to the second imaginary axis AX2, and the angle $\alpha 2$ is equal to the adjustable angle. Each of the projecting portions 536 is formed so as to be receivable in one of the channels 424 of the contact-holding member 40. Each of the projecting portions 536 has opposite side surfaces 548 each of which works as a second rotation preventer 548 as described later. In other words, the cable-holding member 50 is formed with the second rotation preventers 548. Each of the channels 538 is formed so as to receive one or more of the projections 422. Each of the receiving channels 540 is formed so as to receive one of the projections 422. According to this structure, under the combined state where the contact-holding member 40 and the cable-holding member 50 are combined with each other, each of the cover portions 532 is prevented from riding on the projections 422.

Figure 4:
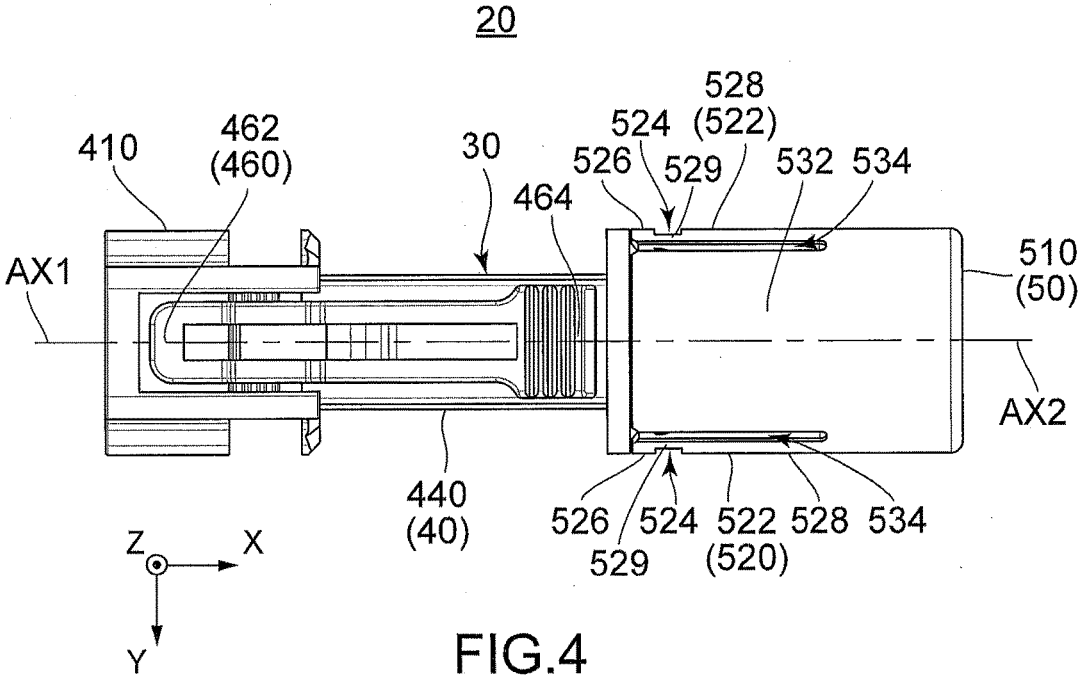
FIG. 4 is a plan view showing the connector of the connector assembly of FIG. 1.
Figure 5:
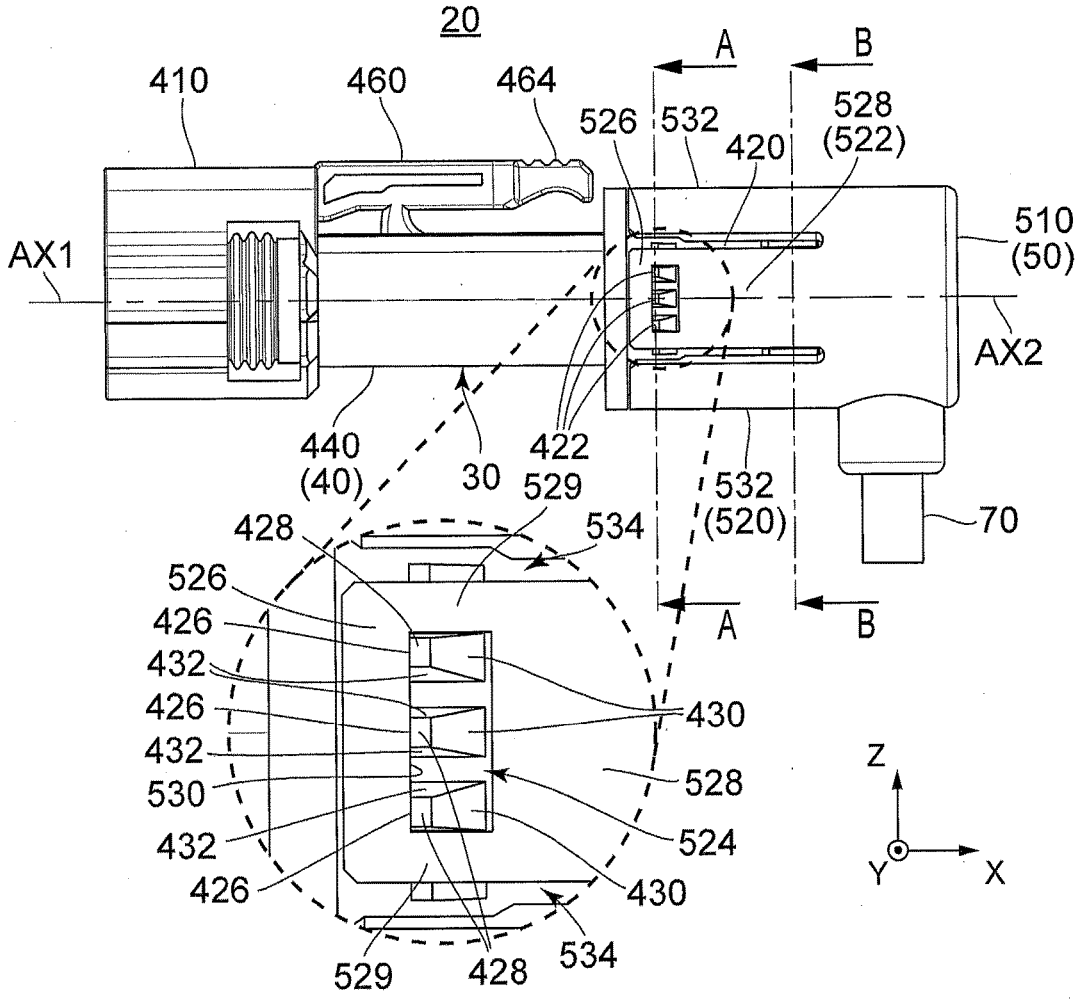
FIG. 5 is a side view showing the connector of FIG. 4, wherein a recessed portion and therearound, which are provided to a cable-holding member of the connector, are enlarged to be illustrated.

As can be seen from FIGS. 4 to 6 and 10, when the contact-holding member 40 and the cable-holding member 50 are combined with each other under the state where the first imaginary axis AX1 and the second imaginary axis AX2 are equal to each other, the attached portion 420 is received in the receiving portion 520. In the combination process, the front end portion 526 of each of the holding portions 522 is brought into contact with one or more of the projections 422. In the present embodiment, the front end portion 526 is brought into contact with three or four of the projections 422. The rear surface 430 of each of the projections 422 slopes rearward relative to a radial direction of the first imaginary axis AX1. In other words, the rear surface 430 slopes so that the projection 422 gradually increases in height toward the front end thereof. Therefore, the front end portion 526 of each of the holding portions 522 rides on the rear surfaces 430 of the projections 422. As a result, the support portion 528 of each of the holding portions 522 is resiliently deformed so that the front end portion 526 is moved forward beyond the projections 422 while surmounting the upper surfaces 428 of the projections 422. When the combination process is performed under a state where the recessed portion 524 of each of the holding portions 522 is arranged to be located at a position same as another position of three of the projections 422 in the circumference direction of both the second imaginary axis AX2 and the first imaginary axis AX1, the three of the projections 422 are, at least in part, received in the recessed portion 524. Moreover, as shown in FIG. 8, each of the support beams 529 is, at least in part, located between two of the projections 422 that are adjacent to each other in the circumference direction of the first imaginary axis AX1. Each of the thus-located support beams 529 rides on none of the projections 422. In other words, each of the support beams 529 is not in contact with the front surface 426, the upper surface 428 and the rear surface 430 (see FIG. 10) of any of the projections 422. Therefore, under the combined state where the contact-holding member 40 and the cable-holding member 50 are combined with each other, each of the support portions 528 is prevented from riding on the projection 422 and is prevented from floating up. As a result, as shown in FIG. 5, the front end portion 526 of each of the holding portions 522 is located forward of the projections 422 received in the recessed portion 524 because of a restoring force of the support portion 528. The front surface 426 of each of the projections 422 faces forward, and each of the front inner surfaces 530 faces rearward. In other words, the front surface 426 of each of the projections 422 received in the recessed portion 524 and the front inner surface 530 of the recessed portion 524 face each other in the front-rear direction. When the contact-holding member 40 and the cable-holding member 50 receive a force which works to remove the contact-holding member 40 and the cable-holding member 50 from each other, each of the front inner surfaces 530 is brought into abutment with the thus-received front surfaces 426. This abutment prevents the contact-holding member 40 and the cable-holding member 50 from being removed from each other, and the combined state is maintained. As described above, the front surface 426 of each of the projections 422 works as the first stop portion 426, and the front inner surface 530 of each of the recessed portions 524 works as the second stop portion 530.

Figure 6:
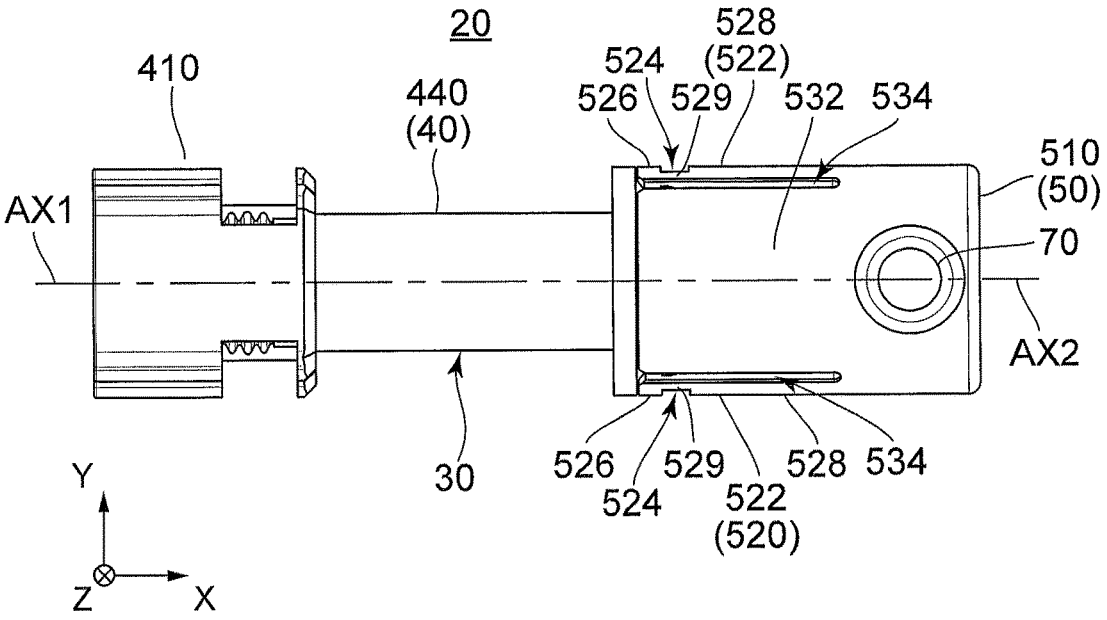
FIG. 6 is a bottom view showing the connector of FIG. 4.
Figure 7:
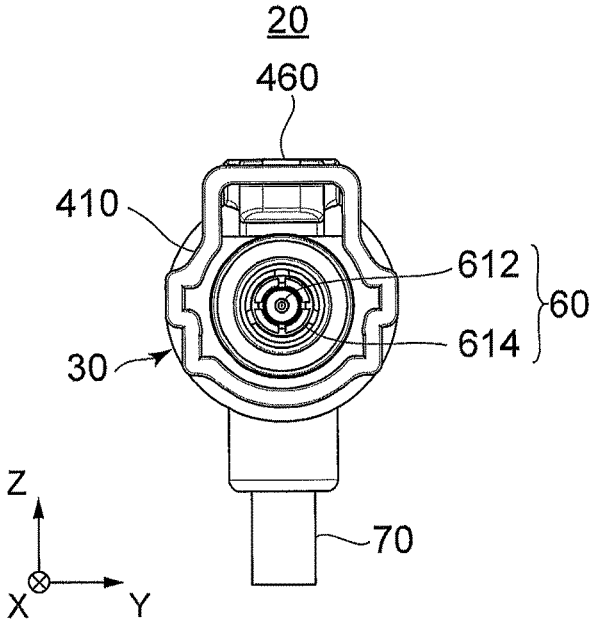
FIG. 7 is a front view showing the connector of FIG. 4.

As can be seen from FIGS. 4 to 6, under the combined state where the contact-holding member 40 and the cable-holding member 50 are combined with each other, the contact-holding member 40 is partially located forward of the cable-holding member 50 in the front-rear direction. In detail, the fit portion 410 and the coupling portion 440 of the contact-holding member 40 are located forward of the cable-holding member 50.

As shown in FIG. 8, under the combined state where the contact-holding member 40 and the cable-holding member 50 are combined with each other, each of the recessed portions 524 receives, at least in part, one or more of the projections 422 as described above. In the present embodiment, each of the recessed portions 524 partially receives three of the projections 422. Under the combined state, the projections 422 are grouped into the projections 422 of a first group that are received in the recessed portions 524 and the projections 422 of a second group that are not received in any of the recessed portions 524. In other words, the first stop portions 426 (see FIGS. 5 and 10), or the front surfaces 426 of the projections 422, are grouped into the first group of one or more of the first stop portions 426 and the second group of remaining one or more of the first stop portions 426. As can be seen from FIG. 5, each of the first stop portions 426 of the first group faces one of the front inner surfaces 530, or one of the second stop portions 530, in the front-rear direction. In other words, each of the second stop portions 530 faces one or more of the first stop portions 426 of the first group in the front-rear direction. In the present embodiment, each of the second stop portions 530 faces two or more of the first stop portions 426 in the front-rear direction. In contrast, each of the first stop portions 426 of the second group faces none of the second stop portions 530 in the front-rear direction. According to the present embodiment, each of the second stop portions 530 is arranged to correspond to one or more of the first stop portions 426 of the first group, or one or more of the first stop portions 426 selected from the first stop portions 426. According to this correspondence, the relative angle of the cable-holding member (second holding member) 50 relative to the contact-holding member (first holding member) 40 can be changed by small degrees. Moreover, the first stop portions 426 include the first stop portions 426 of the second group, or the first stop portions 426 each of which corresponds to none of the second stop portions 530 under the combined state where the contact-holding member 40 and the cable-holding member 50 are combined with each other. This design facilitates to suppress increase of the number of the support portions 528 which support the second stop portions 530. As a result, complication of the structure of the cable-holding member 50 can be avoided, and strength of the cable-holding member 50 can be secured. As described above, according to the present embodiment, the relative angle of the second holding member 50 relative to the first holding member 40 can be adjusted by small degrees while the structure of the second holding member 50 is simplified and strengthened. Although each of the recessed portions 524 of the present embodiment receives three of the projections 422, each of the recessed portions 524 may receive one or more of the projections 422. However, the recessed portion 524 which receives a plurality of the projections 422 can be easily made because having a size larger than another size of the recessed portion 524 which receives only one of the projections 422. Moreover, although each of the holding portions 522 of the present embodiment is provided with one of the recessed portions 524, each of the holding portions 522 may be provided with two or more of the recessed portions 524. However, the holding portion 522 can be easily made when the number of the recessed portions 524 is small. Moreover, as the number of the projections 422 received in the recessed portions 524 is larger, the combined state where the contact-holding member 40 and the cable-holding member 50 are combined with each other can be more securely maintained. Moreover, as each of the holding portions 522 has larger size in the circumference direction of the second imaginary axis AX2, the support portion 528 has higher resilient force so that the combined state where the contact-holding member 40 and the cable-holding member 50 are combined with each other can be more securely maintained.

Referring to FIG. 8, one or more of the projections 422 of the second group that are not received in the recessed portions 524 are accommodated in the slits 534. In other words, one or more of the first stop portions 426 of the second group are accommodated in the slits 534. Each of the slits 534 is formed to have a size which is sufficient to accommodate one or more of the projections 422. In detail, each of the slits 534 is formed to have a width in the circumference direction of the second imaginary axis AX2 which is sufficient to accommodate one or more of the projections 422. In the present embodiment, each of the slits 534 accommodates one of the projections 422, or one of the first stop portions 426 of the second group. However, the width of the slit 534 in the circumference direction of the second imaginary axis AX2 may be wide so that two or more of the projections 422 can be accommodated. Instead, the width of the slit 534 may be narrower than a width of the projection 422.

As can be seen from FIG. 8, each of the receiving channels 540 accommodates remaining one or more of the projections 422 of the second group, so that each of the cover portions 532 faces one or more of the first stop portions 426 of the thus-received one or more of projections 422 of the second group in the radial direction of the first imaginary axis AX1. In the circumference direction of the second imaginary axis AX2, at least one of the side surfaces 432 of each of the projections 422 received in the receiving channel 540 faces one of sidewalls 546 of the receiving channel 540. The side surface 432 of the projection 422 and the sidewall 546 of the receiving channel 540 that face each other are brought into abutment with each other when the cable-holding member 50 and the contact-holding member 40 are forced to be rotated relative to each other about the first imaginary axis AX1 or the second imaginary axis AX2. In other words, the side surface 432 of the projection 422 and the sidewall 546 of the receiving channel 540 that face each other prevent the rotation of the cable-holding member 50 relative to the contact-holding member 40 about the second imaginary axis AX2 (first imaginary axis AX1).

As shown in FIG. 9, under the combined state where the contact-holding member 40 and the cable-holding member 50 are combined with each other, each of the projecting portions 536 of the cable-holding member 50 is received in one of the channels 424 of the contact-holding member 40. The opposite side surfaces 548 of the projecting portion 536 that is received in the corresponding channel 424 face the opposite sidewalls 434 of the corresponding channel 424 in the circumference direction of the second imaginary axis AX2, respectively. In other words, under the combined state where the contact-holding member 40 and the cable-holding member 50 are combined with each other, each of the first rotation preventers 434 and corresponding one of the second rotation preventers 548 face each other in the circumference direction of both the first imaginary axis AX1 and the second imaginary axis AX2. The side surface 548 of the projecting portion 536 and the sidewall 434 of the channel 424 that face each other are brought into abutment with each other when the cable-holding member 50 and the contact-holding member 40 are forced to be rotated relative to each other about the first imaginary axis AX1 or the second imaginary axis AX2. In other words, the side surface 548 of the projecting portion 536 and the sidewall 434 of the channel 424 that face each other prevent the rotation of the cable-holding member 50 relative to the contact-holding member 40 about the second imaginary axis AX2 (first imaginary axis AX1). As described above, the side surface 548 of the projecting portion 536 and the sidewall 434 of the channel 424 that face each other work as the first rotation preventer 434 and the second rotation, preventer 548, respectively. According to the present embodiment, the rotation of the cable-holding member 50 relative to the contact-holding member 40 is prevented by the combination of the first rotation preventers 434 and the second rotation preventers 548 in addition to the combination of the projections 422 and the receiving channels 540. Thus, the rotation of the cable-holding member 50 relative to the contact-holding member 40 can be more securely prevented.

Figure 11:
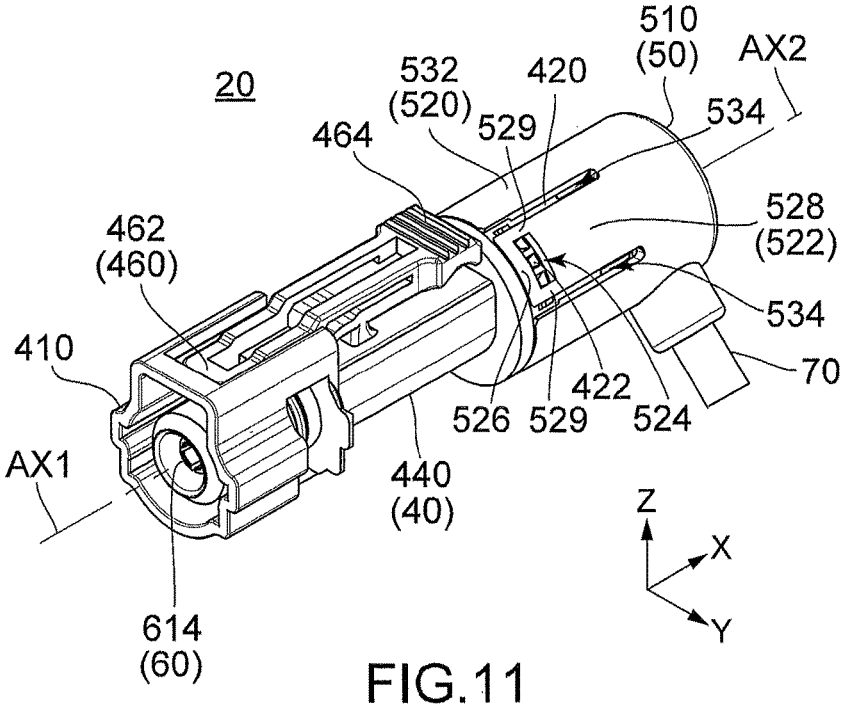
FIG. 11 is another perspective view showing the connector of FIG. 4, wherein the contact-holding member and the cable-holding member are combined with each other so that the cable connected to the connector extends in a direction intersecting with an upper-lower direction.

As can be seen from comparison between FIGS. 1 and 11, when the contact-holding member 40 and the cable-holding member 50 are combined with each other, the relative angle of the cable-holding member 50 relative to the contact-holding member 40 can be changed in the circumference direction of the second imaginary axis AX2. In other words, an angle of an extending direction of the cable 70, or a direction along which the cable 70 starts to extend from the cable-holding member 50, can be adjusted relative to the contact-holding member 40. According to the present embodiment, since the projections 422 are formed at regular intervals in the circumference direction of the first imaginary axis AX1, the extending direction of the cable 70 can be adjusted by regular angles. According to the holding member 30 of the present embodiment, the extending direction of the cable 70 can be adjusted by small degrees in comparison with the first connector unit and the second connector unit of Patent Document 1. In addition, since each of the resiliently deformable holding portions 522 is provided with the front inner surface 530, or the second stop portion 530, each of the projections 422 can be made large so that each of the front surfaces 426, or each of the first stop portions 426, can be made large. The aforementioned structure improves the ability of maintaining the combined state where the contact-holding member 40 and the cable-holding member 50 are combined with each other so that the combined state can be securely maintained.

In the aforementioned embodiment, the contact-holding member 40 has two or more of the projections 422, and the cable-holding member 50 has one or more of the recessed portions 524. However, the present invention is not limited thereto. For example, the contact-holding member 40 may have two or more recessed portions, and the cable-holding member 50 may have one or more projections. In this modification, each of the recessed portions may be partially defined by a rear inner surface which works as a first stop portion, and each of the projections may have a rear surface which works as a second stop portion.

In the aforementioned embodiment, the contact-holding member 40 has two or more of the projections 422, and the cable-holding member 50 has one or more of the holding portions 522. However, the present invention is not limited thereto. For example, the contact-holding member 40 may have one or more holding portions, and the cable-holding member 50 may have two or more projections. In this modification, the cable-holding member 50 is a first holding member, and the contact-holding member 40 is a second holding member. According to this modification, "forward" means the positive X-direction, and "rearward" means the negative X-direction.

Second Embodiment

Figure 12:
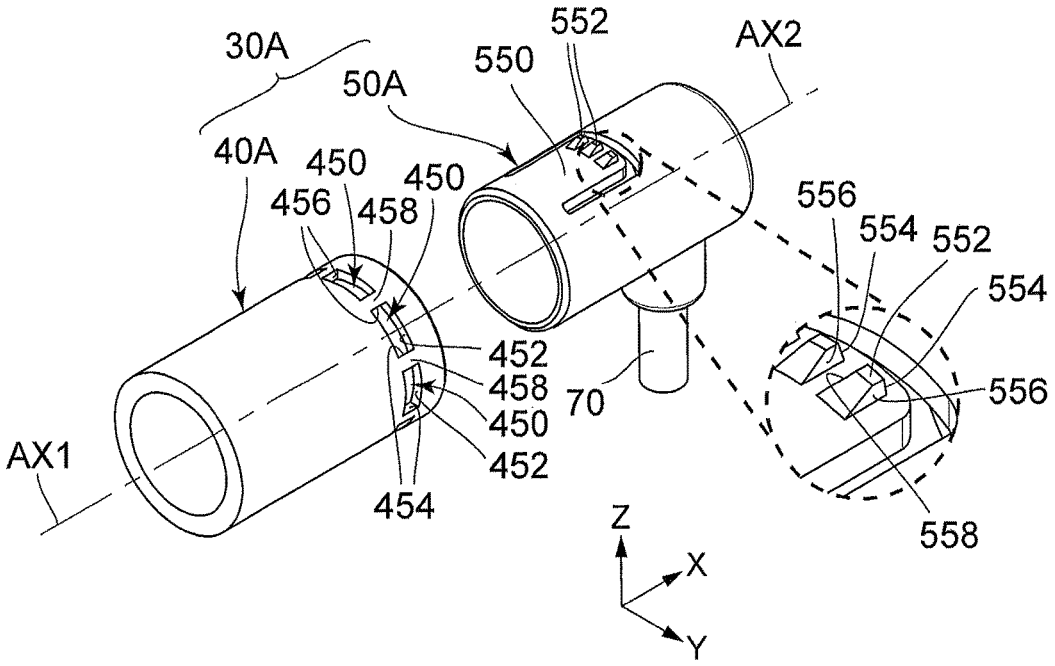
FIG. 12 is a perspective view showing a holding member according to a second embodiment of the present invention, wherein the holding member includes a contact-holding member and a cable-holding member which are not combined with each other, and a cable held by the cable-holding member is partially illustrated.

Referring to FIG. 12, a holding member 30A according to a second embodiment of the present invention comprises a contact-holding member (first holding member) 40A and a cable-holding member (second holding member) 50A. The contact-holding member 40A holds a contact (not shown), and the cable-holding member 50A holds the cable 70.

As shown in FIG. 12, the contact-holding member 40A has two or more recessed portions 450 arranged along the circumference direction of the first imaginary axis AX1. In the present embodiment, each of the recessed portions 450 is a hole which passes through the contact-holding member 40A in the radial direction of the first imaginary axis AX1. In the present embodiment, the number of the recessed portions 450 is eight. Each of the recessed portions 450 is partially defined by a wall surface 454 and an opposite wall surface 456 which are arranged along the circumference direction of the first imaginary axis AX1. The cable-holding member 50A has one or more support portions 550 each of which is resiliently deformable and one or more projections 552 each of which is supported by one of the support portions 550. In the present embodiment, the number of the support portion 550 is one, and the number of the projections 552 is three. The support portion 550 extends rearward from a front part of the cable-holding member 50A in a front-rear direction. Each of the projections 552 has a side surface 556 and an opposite side surface 558 which are arranged along the circumference direction of the second imaginary axis AX2. Each of the projections 552 is movable in an intersecting direction intersecting with the front-rear direction in accordance with the resilient deformation of the support portion 550.

Figure 13:
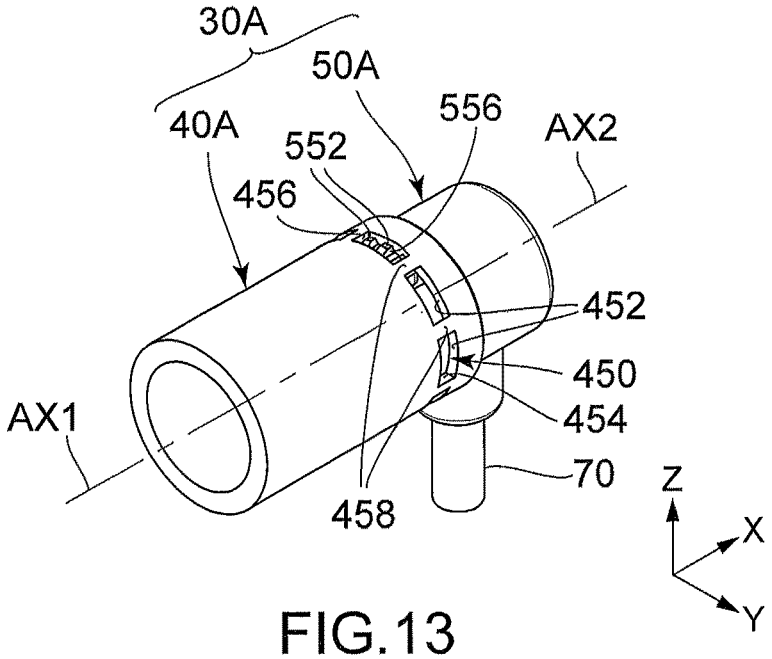
FIG. 13 is another perspective view showing the holding member of FIG. 12, wherein the contact-holding member and the cable-holding member of the holding member are combined with each other.
Figure 14:
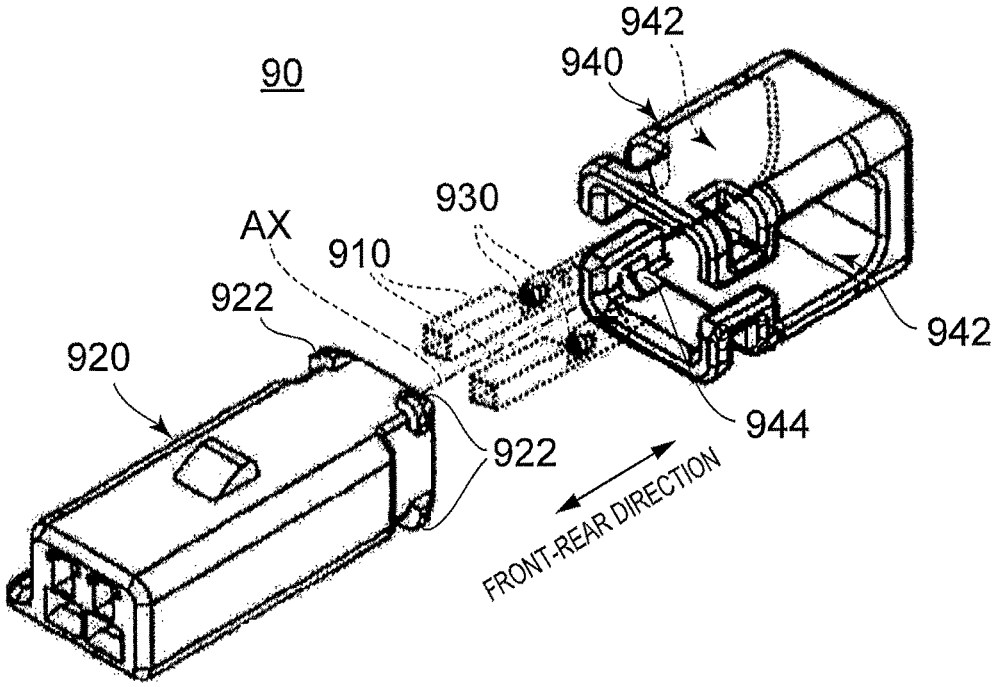
FIG.14 PRIOR ART
FIG. 14 is an exploded, perspective view showing a connector unit (first connector unit) disclosed in Patent Document 1.
Figure 15:
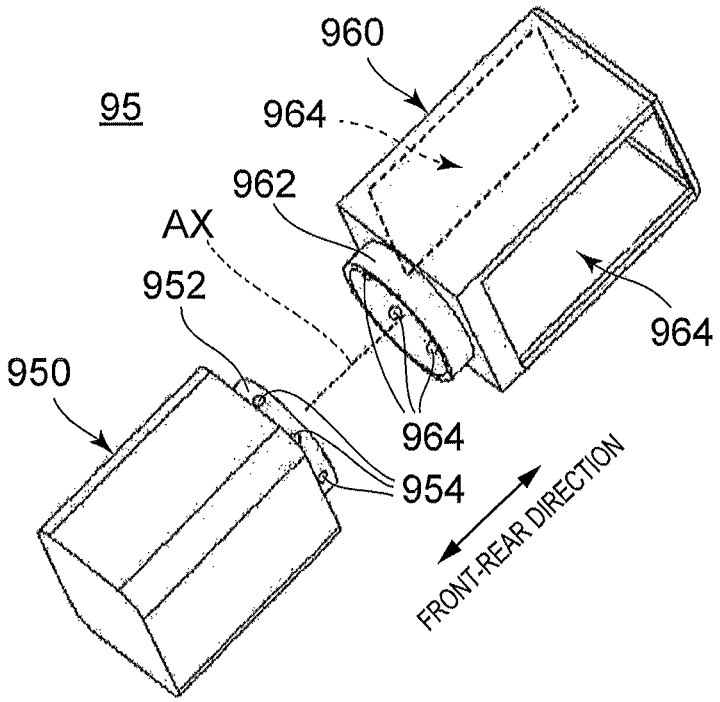
FIG.15 PRIOR ART
FIG. 15 is an exploded, perspective view showing another connector unit (second connector unit) disclosed in Patent Document 1.

As can be seen from FIGS. 12 and 13, when a front part of the cable-holding member 50A is inserted into the contact-holding member 40A under the state where the first imaginary axis AX1 and the second imaginary axis AX2 are equal to each other, the contact-holding member 40A receives a part of the cable-holding member 50A. In this insertion process, the support portion 550 is resiliently deformed so that the projections 552 are received in the contact-holding member 40A. When the insertion process is performed under a state where the positions of the projections 552 are properly adjusted to the positions of the recessed portions 450 in each of the front-rear direction and the circumference direction of the first imaginary axis AX1 (second imaginary axis AX2), each of the projections 552 is, at least in part, received in corresponding one of the recessed portions 450 because of a restoring force of the support portion 550. As a result, the contact-holding member 40A and the cable-holding member 50A takes a combined state. When the contact-holding member 40A and the cable-holding member 50A receive a force which works to remove the contact-holding member 40A and the cable-holding member 50A from each other under this combined state, each of the projections 552 and the corresponding one of the recessed portions 450 are engaged with each other so that the combined state where the contact-holding member 40A and the cable-holding member 50A are combined with each other is securely maintained. Each of the recessed portions 450 is partially defined by a rear inner surface 452 which faces forward in the front-rear direction. Each of the projections 552 has a rear surface 554. Under the combined state, each of the rear inner surface 452 works as a first stop portion 452, and each of the rear surface 554 works as a second stop portion 554.

As shown in FIG. 13, under the combined state where the contact-holding member 40A and the cable-holding member 50A are combined with each other, each of the projections 552 is received in the corresponding one of the recessed portions 450. In the present situation shown in FIG. 13, all of the three projections 552 are received in a predetermined one of the recessed portions 450. However, in two unillustrated situations, the three projections 552 may be separately received in adjacent two of the recessed portions 450. In one of the situations where the three projections 552 are separately received in adjacent two of the recessed portions 450, one of the two recessed portions 450 may receive one of the projections 552 while a remaining one of the two recessed portions 450 may receive remaining two of the projections 552. In a remaining one of the situations where the three projections 552 are separately received in adjacent two of the recessed portions 450, one of the two recessed portions 450 may receive two of the projections 552 while a remaining one of the two recessed portions 450 may receive a remaining one the projections 552. In the situation where the three projections 552 are separately received in adjacent two of the recessed portions 450, a support wall 458, which is located between the adjacent two recessed portions 450, is located between two of the projections 552 in the circumference direction of the first imaginary axis AX1. In each of the aforementioned three situations, the wall surface 454, which partially defines one of the recessed portions 450, faces the side surface 556 (see FIG. 12) of one of the projections 552. In addition, the opposite wall surface 456, which partially defines one of the recessed portions 450, faces the opposite side surface 558 (see FIG. 12) of one of the projections 552. This arrangement prevents the cable-holding member 50A from being rotated relative to the contact-holding member 40A about the second imaginary axis AX2. Moreover, according to this arrangement, the number of directions each of which the cable 70 extends along can be made larger than the number of the recessed portions 450. According to the present embodiment, the eight recessed portions 450 are provided, and the three projections 552 are provided, so that the relative angle of the cable-holding member 50A relative to the contact-holding member 40A about the second imaginary axis AX2 can be changed in twenty four ways. In other words, the extending direction of the cable 70 relative to the contact-holding member 40A can be changed in twenty four ways.

Although each of the recessed portions 450 of the present embodiment is the hole which passes through the contact-holding member 40A, each of the recessed portions 450 may be a recess which opens inward of the contact-holding member 40A. Moreover, although the number of the recessed portions 450 of the present embodiment is eight, the number of the recessed portions 450 may be more than or less than eight. Moreover, although the number of the support portion 550 of the present embodiment is one, the number of the support portions 550 may be two or more. Moreover, although the number of the projections 552 of the present embodiment is three, the number of the projections 552 may be one or more in each of the support portions 550. Each of the number of the recessed portions 450, the number of the support portions 550 and the number of the projections 552 can be properly designed in consideration of the strength of each of the contact-holding member 40A and the cable-holding member 50A and the ability of maintaining the combined state of the contact-holding member 40A and the cable-holding member 50A. Regardless of the number of the recessed portions 450, the number of the support portions 550 and the number of the projections 552, each of the projections 552 may be designed to be, at least in part, received in one of the recessed portions 450 under the combined state where the contact-holding member 40A and the cable-holding member 50A are combined with each other. Moreover, under the combined state where the contact-holding member 40A and the cable-holding member 50A are combined with each other, only one of the wall surfaces 454 of all of the recessed portions 450 may face one of the side surfaces 556 of all of the projections 552, and only one of the opposite wall surfaces 456 of all of the recessed portions 450 may face one of the opposite side surfaces 558 of all of the projections 552. This arrangement prevents the rotation of the cable-holding member 50A relative to the contact-holding member 40A about the second imaginary axis AX2. Moreover, the number of the extending directions of the cable 70 can be made larger than the number of the recessed portions 450.

In the present embodiment, the contact-holding member 40A is formed with two or more of the recessed portions 450, and the cable-holding member 50A has one or more of the support portions 550 and one or more of the projections 552. However, the present invention is not limited thereto. For example, the contact-holding member 40A may have one or more support portions and one or more projections, and the cable-holding member 50A may be formed with two or more recessed portions. In this modification, the cable-holding member 50A is a first holding member, and the contact-holding member 40A is a second holding member. In this modification, "forward" means the positive X-direction, and "rearward" means the negative X-direction.

While explanation has been specifically made about some embodiments of the present invention, the present invention is not limited thereto, but various modifications and changes can be made. For example, although each of the contact-holding members 40 and 40A and the cable-holding members 50 and 50A of the aforementioned first and second embodiments is formed of a single component, each of the contact-holding members 40 and 40A and the cable-holding members 50 and 50A may be formed of a plurality of components. For example, each of the cable-holding members 50 and 50A may be formed of two components, or an engagement component formed with one or more second stop portions and a cable-holding component formed with a cable holding portion which holds the cable 70.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A holding member configured to form a connector which comprises a contact connected to a cable, wherein:

the holding member comprises a first holding member and a second holding member, one of which is configured to hold the contact, and a remaining one of which is configured to hold the cable;

the first holding member and the second holding member have a first imaginary axis and a second imaginary axis, respectively;

the first holding member and the second holding member are combinable with each other along a front-rear direction under a state where the first imaginary axis and the second imaginary axis are equal to each other;

one of the first holding member and the second holding member that is configured to hold the cable has a cable holding portion which is configured to hold a part of the cable so that the cable extends in a direction different from the front-rear direction;

the first holding member has first stop portions;

the second holding member has one or more support portions and one or more second stop portions;

each of the support portions is resiliently deformable;

each of the second stop portions is supported by one of the support portions;

each of the second stop portions supported by the one of the support portions is movable in a direction intersecting with the front-rear direction in accordance with resilient deformation of the one of the support portions; and under a combined state where the first holding member and the second holding member are combined with each other, the first stop portions are grouped into a first group of one or more of the first stop portions and a second group of remaining one or more of the first stop portions, each of the second stop portions faces one or more of the first stop portions of the first group in the front-rear direction, and each of the first stop portions of the second group faces none of the second stop portions in the front-rear direction.

2. The holding member as recited in claim 1, wherein:

under the combined state, the first holding member is partially located forward of the second holding member in the front-rear direction;

the first holding member has projections;

each of the projections has a front surface;

each of the front surfaces works as the first stop portion;

the second holding member has one or more recessed portions;

under the combined state, each of the recessed portions receives, at least in part, one or more of the projections;

each of the recessed portions is partially defined by a front inner surface;

each of the front inner surfaces faces rearward in the front-rear direction; and each of the front inner surfaces works as the second stop portion.

3. The holding member as recited in claim 2, wherein each of the recessed portions passes through one of the support portions in a radial direction of the second imaginary axis.

4. The holding member as recited in claim 2, wherein:

the second holding member has two or more slits and one or more cover portions;

each of the slits extends along the front-rear direction;

each of the cover portions is hard to be resiliently deformed in comparison with each of the support portions; and each of the slits is located between one of the cover portions and one of the support portions in a circumference direction of the second imaginary axis.

5. The holding member as recited in claim 4, wherein:

each of the support portions has a support beam which is located between one of the slits and one of the recessed portions in a circumference direction of the second imaginary axis; and under the combined state, each of the support beams is, at least in part, located between two of the projections that are adjacent to each other in a circumference direction of the first imaginary axis and rides on none of the projections.

6. The holding member as recited in claim 4, wherein under the combined state, each of the cover portions faces one or more of the first stop portions of the second group in a radial direction of the first imaginary axis.

7. The holding member as recited in claim 6, wherein:

each of the cover portions is formed with one or more receiving channels each extending in the front-rear direction; and under the combined state, each of the receiving channels accommodates one or more of the first stop portions.

8. The holding member as recited in claim 2, wherein:

the first holding member is formed with a first rotation preventer;

the second holding member is formed with a second rotation preventer; and under the combined state, the first rotation preventer and the second rotation preventer face each other in a circumference direction of both the first imaginary axis and the second imaginary axis.

9. The holding member as recited in claim 2, wherein under the combined state, one of the second stop portions faces two or more of the first stop portions in the front-rear direction.

10. The holding member as recited in claim 1, wherein:

the second holding member has two of the support portions; and each of the support portions supports one or more of the second stop portions.

11. The holding member as recited in claim 1, wherein the first stop portions are arranged at regular intervals in a circumference direction of the first imaginary axis.

12. The holding member as recited in claim 1, wherein:

under the combined state, the first holding member is partially located forward of the second holding member in the front-rear direction;

the first holding member has recessed portions;

the second holding member has projections;

under the combined state, each of the projections is, at least in part, received in one of the recessed portions;

each of the recessed portions is partially defined by a rear inner surface;

each of the rear inner surfaces faces forward in the front-rear direction;

each of the rear inner surfaces works as the first stop portion;

each of the projections has a rear surface; and each of the rear surfaces works as the second stop portion.

13. The holding member as recited in claim 12, wherein:

each of the recessed portions is partially defined by a wall surface and an opposite wall surface which are arranged in a circumference direction of the first imaginary axis;

each of the projections has a side surface and an opposite side surface which are arranged in a circumference direction of the second imaginary axis;

under the combined state, the wall surface of one of the recessed portions faces the side surface of one of the projections, and the opposite wall surface of one of the recessed portions faces the opposite side surface of one of the projections.

* * * * *